US010234232B1

(12) United States Patent
Liu

(10) Patent No.: US 10,234,232 B1
(45) Date of Patent: Mar. 19, 2019

(54) BIPOD BASE

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/040,312

(22) Filed: Jul. 19, 2018

(51) Int. Cl.
*F41A 23/10* (2006.01)

(52) U.S. Cl.
CPC ..... *F41A 23/10* (2013.01)

(58) Field of Classification Search
CPC ..... F41A 23/10; F41A 23/08
See application file for complete search history.

(56) References Cited

U.S. PATENT DOCUMENTS

2018/0202746 A1* 7/2018 Flood, Jr. ..... F41A 23/10

* cited by examiner

*Primary Examiner* — Reginald S Tillman, Jr.
(74) *Attorney, Agent, or Firm* — Jackson IPG PLLC; Demian K. Jackson

(57) ABSTRACT

A bipod base consisting of a rail clamp, a first quick-release, a ball joint, first and housing clamps, first and second spherical bushings and a second quick-release. When the second quick-release is loosened, the rail clamp is allowed for 360-degree angular position adjustment with the ball of the ball joint relative to the first and second spherical bushings and the first and second housing clamps. After adjustment, the second quick release handle is biased to fasten tight the first and second housing clamps in locking the first and second spherical bushings that are kept in surface contact with the ball of the ball joint.

2 Claims, 13 Drawing Sheets

BIPOD BASE

BACKGROUND AND SUMMARY OF THE INVENTION

The present invention relates to hunting gear and more specifically, to a bipod base for the fixation of a gun, which allows 360-degree tilting rotation angle adjustment in any direction and provides a tight fixing effect with a solid surface contact mode.

Although there are many kinds of bipods available on the market for connecting and supporting guns, there is still a lack of bipods that can be easily adjusted to 360 degrees and tilted in any direction and have a firm and tight fixing effect.

U.S. Pat. No. 8,291,633 discloses a bipod for a lightweight machine gun that allows a user to pivot the bipod legs about cylinder-in-a-cylinder pivot pins, either towards or away from the barrel muzzle with one hand, thus giving 180 degrees of travel. This design of bipod is still not satisfactory in function for the disadvantage of a limited adjustment range.

The present invention has been accomplished under the circumstances in view. It is therefore the main object of the present invention to provide a bipod base for bipod, which allows 360-degree tilting rotation angle adjustment in any direction and provides a tight fixing effect with a solid surface contact mode.

DETAILED DESCRIPTION OF THE INVENTION

Figure 1:
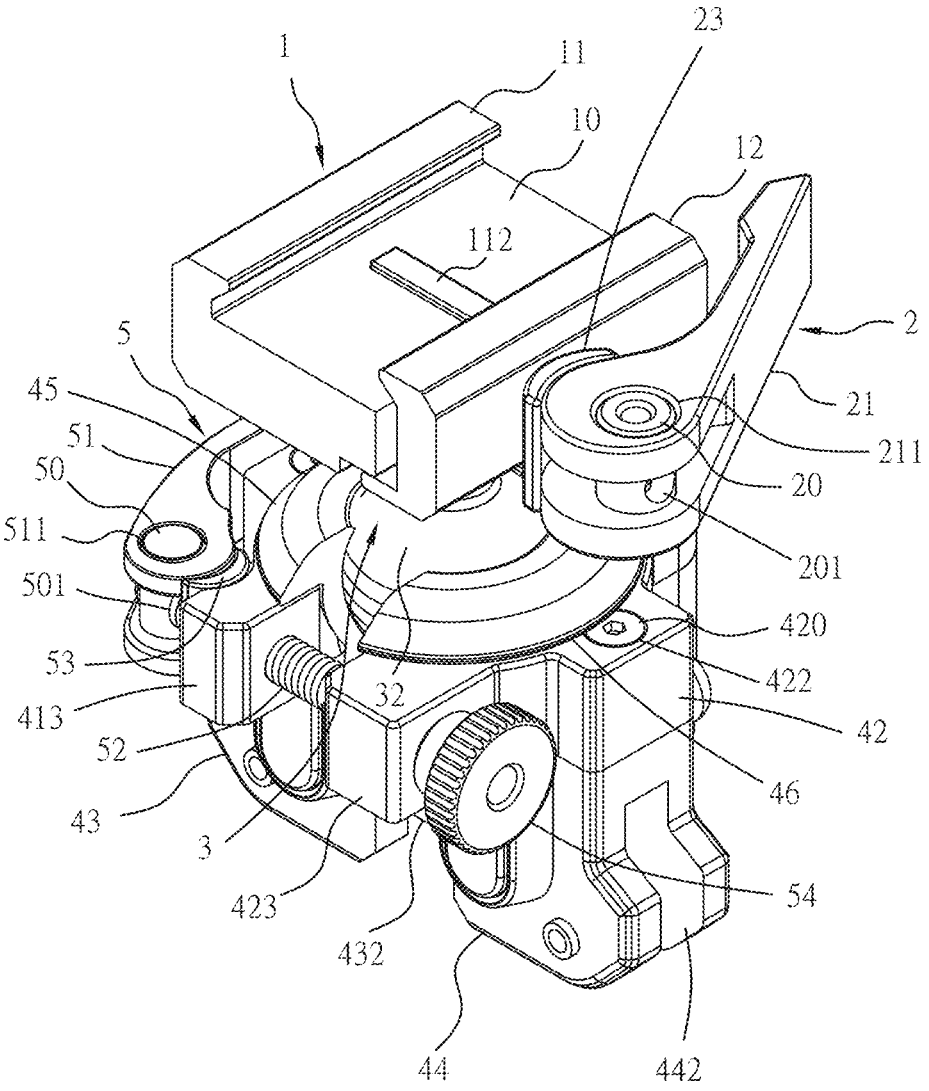
FIG. 1 is an oblique top elevational view of a bipod base in accordance with the present invention.

Referring to FIGS. 1-13, a bipod base in accordance with the present invention is shown. The bipod base comprises a rail clamp 1, a first quick-release 2, a ball joint 3, first and second housing clamps 41,42, first and second spherical bushings 45,46, first and second leg attachments 43,44, and a second quick-release 5.

The rail clamp 1 comprises a fixed rail 11 and a movable rail 12. The fixed rail 11 and the movable rail 12 define therebetween a rail groove 10 in the longitudinal direction for the mounting of a rail 81 of a gun 8 (see FIG. 11). The fixed rail 11 comprises an internally threaded hole 111 extended in the transverse direction (see FIG. 2), at least one engagement block 112 located on a top side thereof, and an internally threaded hole 114 (see FIG. 8) vertically located on an opposing bottom side thereof. The movable rail 12 comprises a through hole 121 (see FIG. 2) aimed at the internally threaded hole 111.

The first quick-release 2 comprises a first quick release handle 21, a first pivot axle 20 (see FIG. 2), a first screw rod 22 (see FIG. 2) and a first gasket 23. The first quick release handle 21 has an eccentric shaft hole 211 located in one end thereof and pivotally coupled to the first pivot axle 20. The first pivot axle 20 has a first screw hole 201 fastened up with one end of the first screw rod 22. The other end 222 of the first screw rod 22 (see FIG. 2) is inserted through the first gasket 23, the through hole 121 of the movable rail 12 of the rail clamp 1 and then threaded into the internally threaded hole 111 of the fixed rail 11 of the rail clamp 1 (see FIG. 2). Thus, biasing the first quick release handle 21 clockwise or counter-clockwise can lock or release the movable rail 12.

The ball joint 3 comprises a rod member 31 (see FIG. 2) and a ball 32 located on a bottom end of the rod member 31. The opposing top end of the rod member 31 is an externally threaded end-piece 311 (see FIG. 8) that is fastened to the internally threaded hole 114 of the fixed rail 11 of the rail clamp 1 (see FIG. 8).

Figure 2:
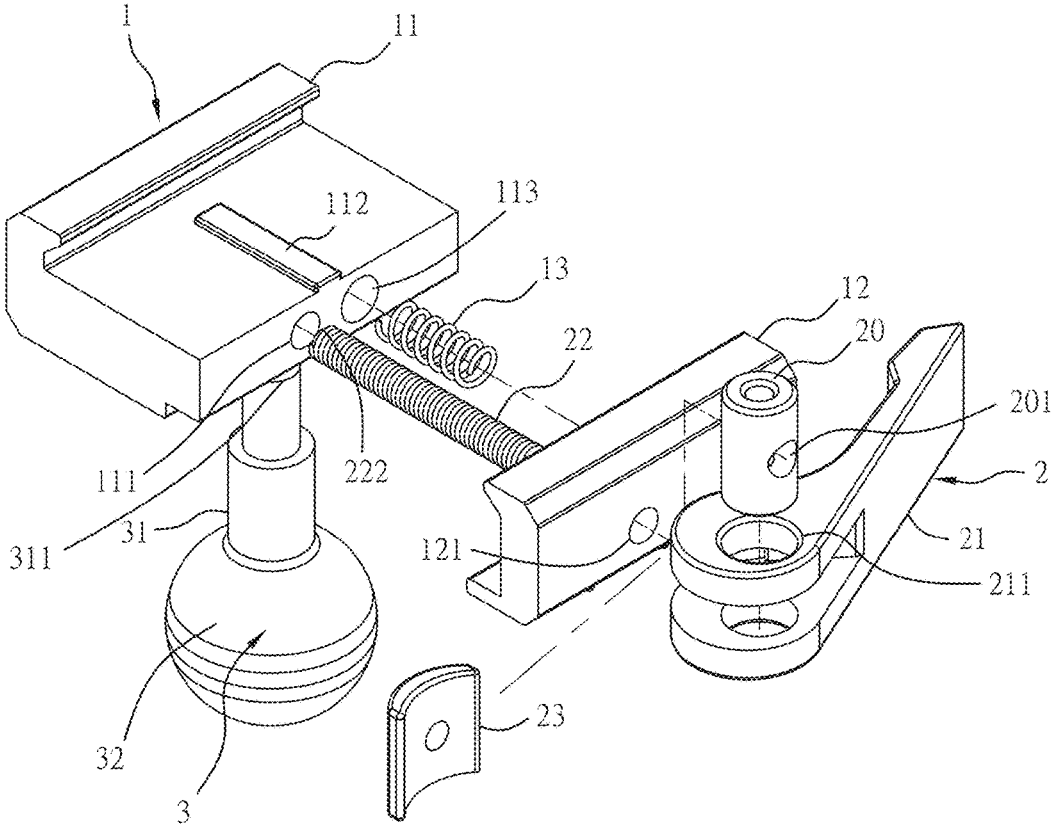
FIG. 2 is an exploded view of the rail clamp, first quick-release and ball joint of the bipod base in accordance with the present invention.
Figure 3:
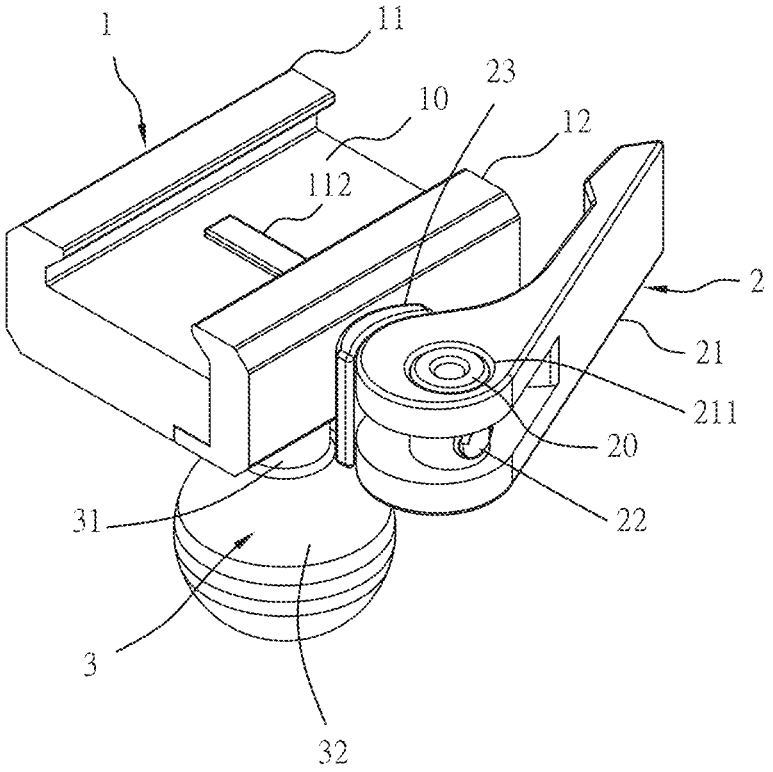
FIG. 3 is an elevational assembly view of the rail clamp, first quick-release and ball joint of the bipod base in accordance with the present invention.

The first housing clamp 41 comprises a protruded first pivot connection portion 411 disposed at one side thereof, a first pivot hole 4111 defined in the first pivot connection portion 411, a first protruded wall 413 disposed at an opposite side thereof, a first through hole 4131 transversely cut through the first protruded wall 413 (see FIG. 4), and a first mounting hole 412 (see FIG. 4) fastened to the first leg attachment 43 with a first fastening member 410 (see FIG. 2).

The second housing clamps 42 comprises a protruded second pivot connection portion 421, a second pivot hole 4211 defined in the second pivot connection portion 421, a second protruded wall 423 disposed at an opposite side thereof, a second through hole 4231 transversely cut through the second protruded wall 423 (see FIG. 4), and a second mounting hole 422 (see FIG. 4) fastened to the second leg attachment 44 with a second fastening member 420 (see FIG. 2).

Figure 4:
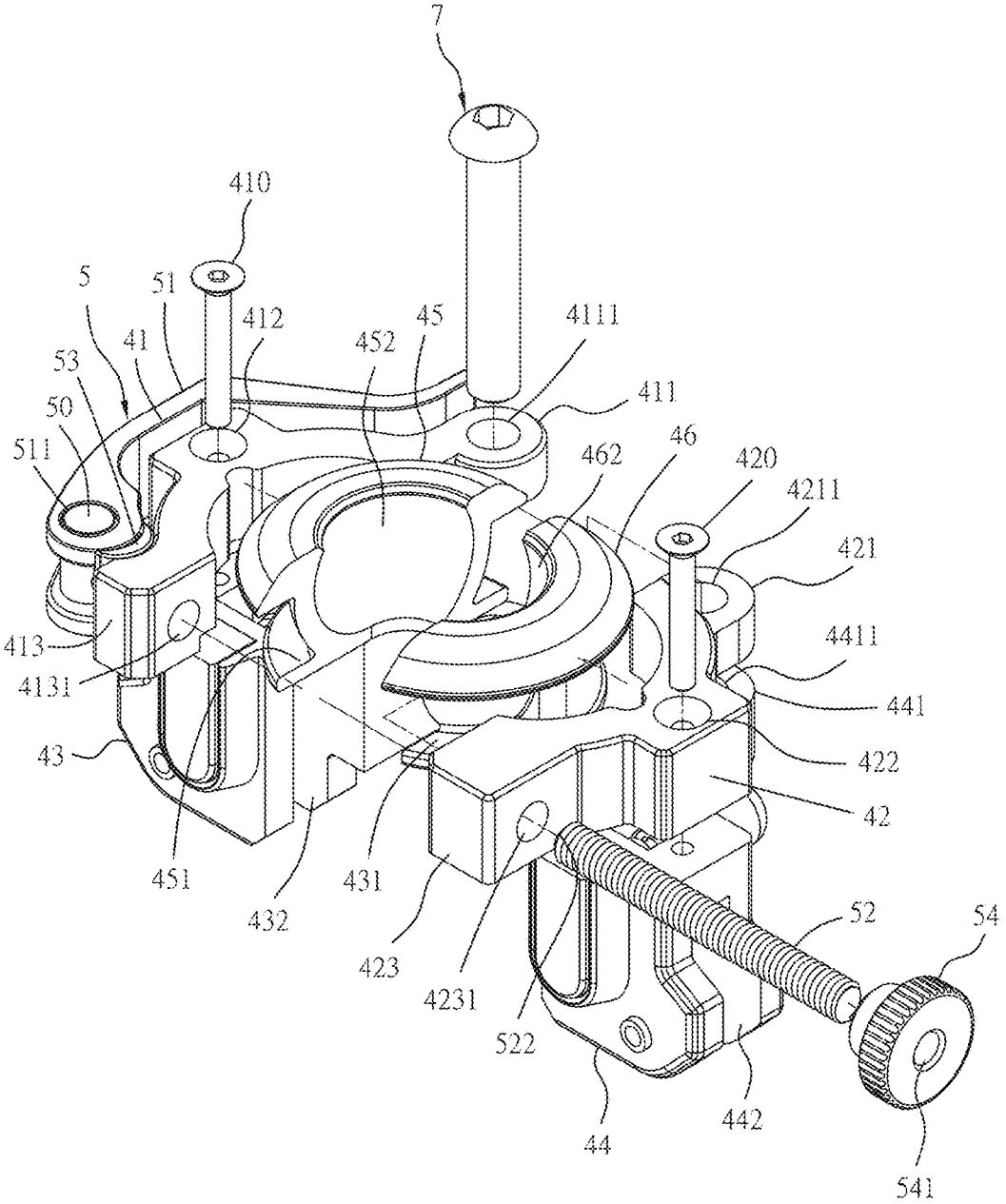
FIG. 4 is an exploded view of the rail clamp, first and second housing clamps, first and second spherical bushings and first and second leg attachments of the bipod base in accordance with the present invention.
Figure 5:
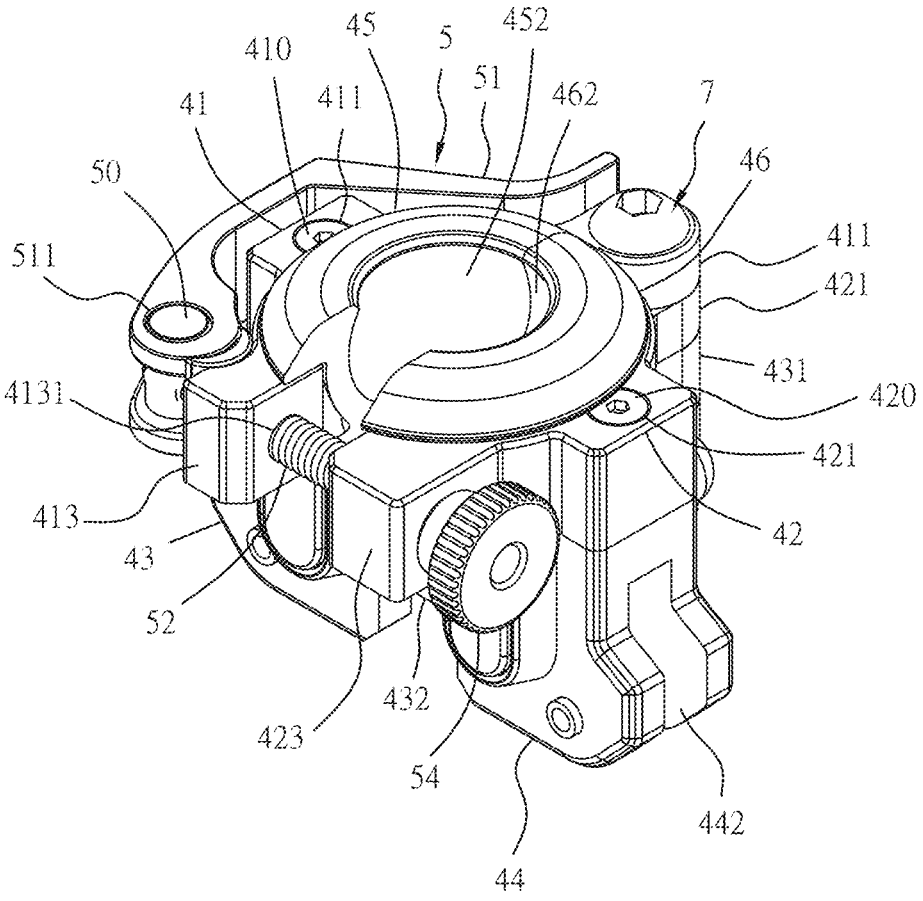
FIG. 5 is an elevational assembly view of the rail clamp, first and 10 second housing clamps, first and second spherical bushings and first and second leg attachments of the bipod base in accordance with the present invention.

The first leg attachment 43 comprises a third pivot connection portion 431 (see FIGS. 6 and 8) disposed at one side thereof, a third pivot hole 4311 defined in the third pivot connection portion 431, and a first leg hole 432 (see FIGS. 1 and 4 for the connection of a first leg (not shown).

The second leg attachment 44 comprises a fourth pivot connection portion 441 (see FIGS. 6 and 8), a fourth pivot hole 4411 defined in the fourth pivot connection portion 441, and a first leg hole 442 (see FIGS. 1 and 4 for the connection of a second leg (not shown).

Figure 6:
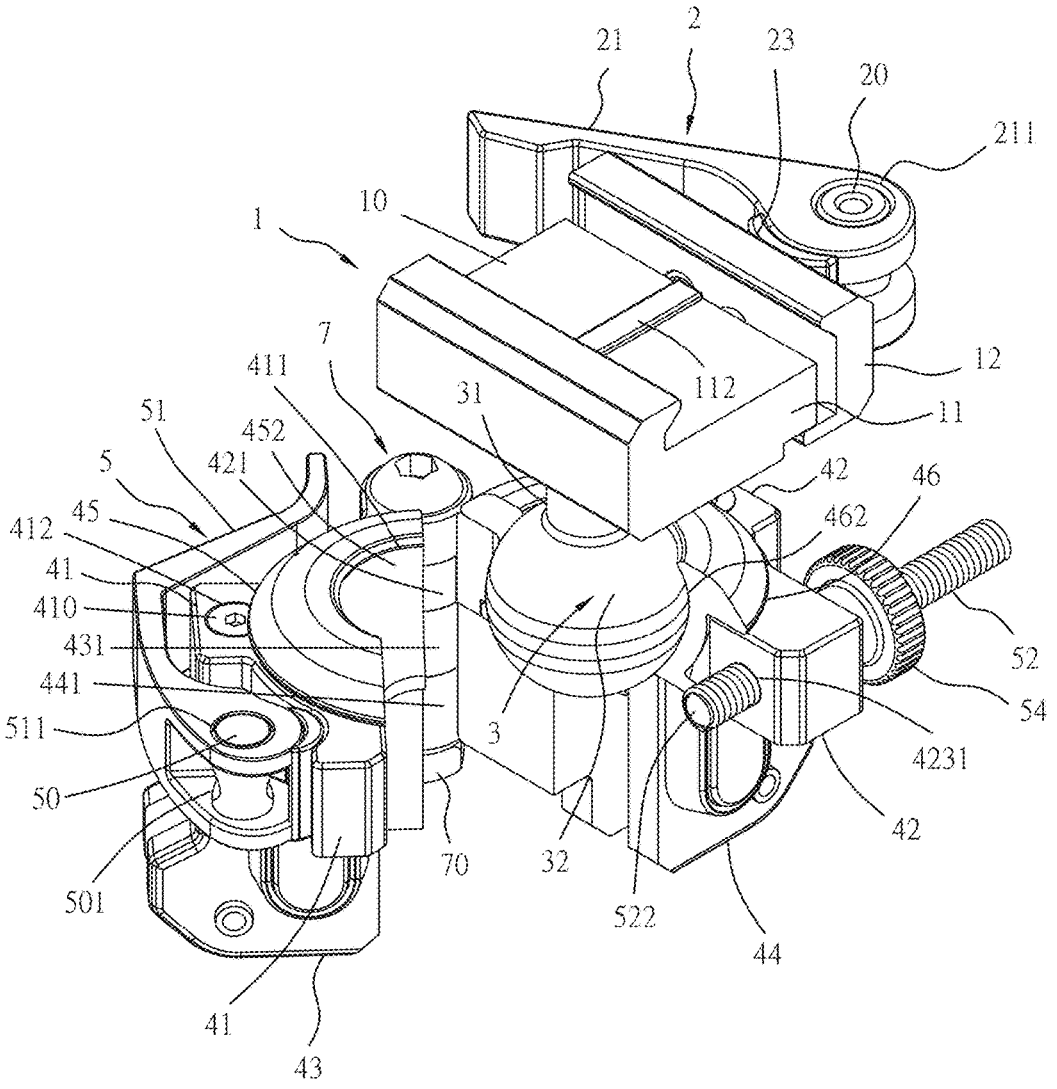
FIG. 6 is an assembly view of the bipod base in accordance with the present invention.
Figure 7:
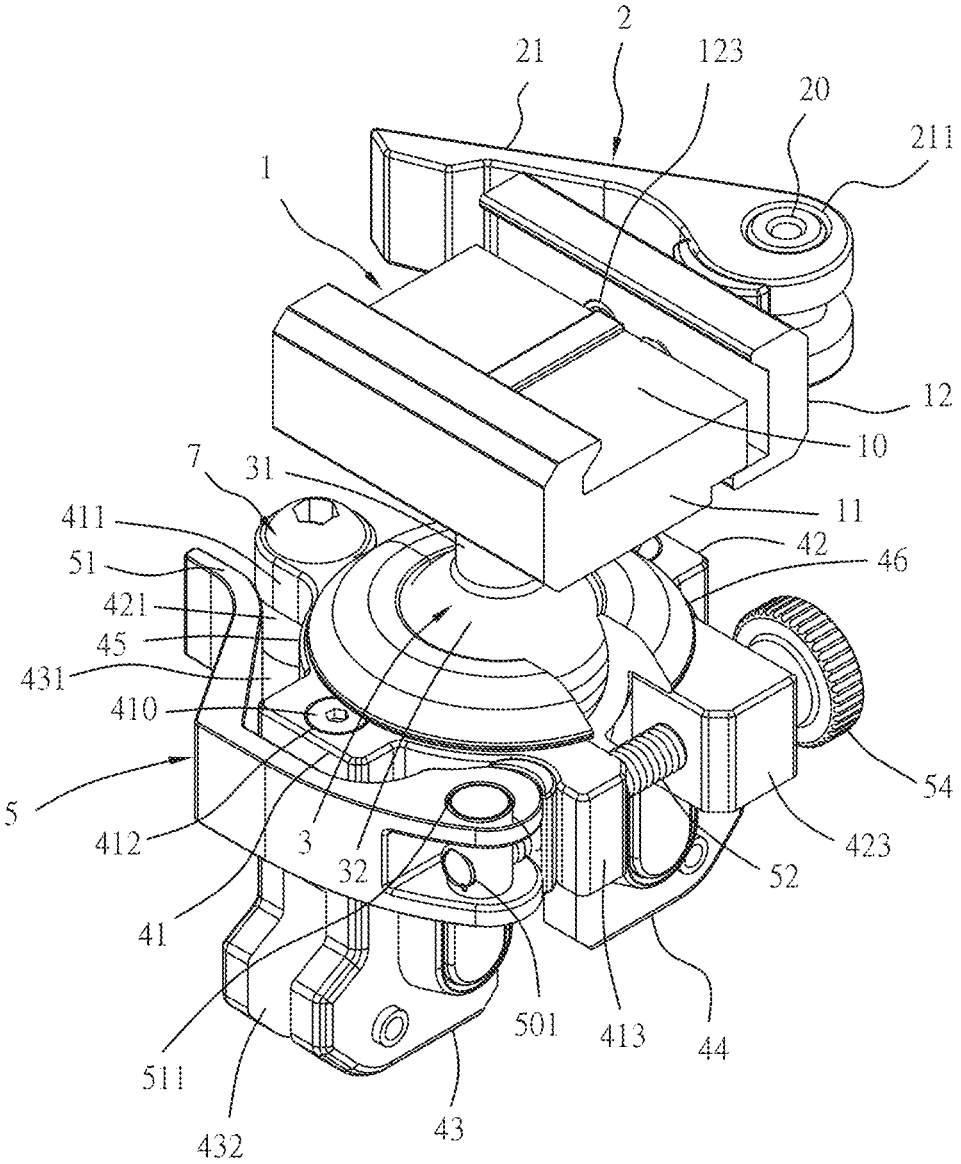
FIG. 7 is another assembly view of the bipod base in accordance with the present invention.
Figure 8:
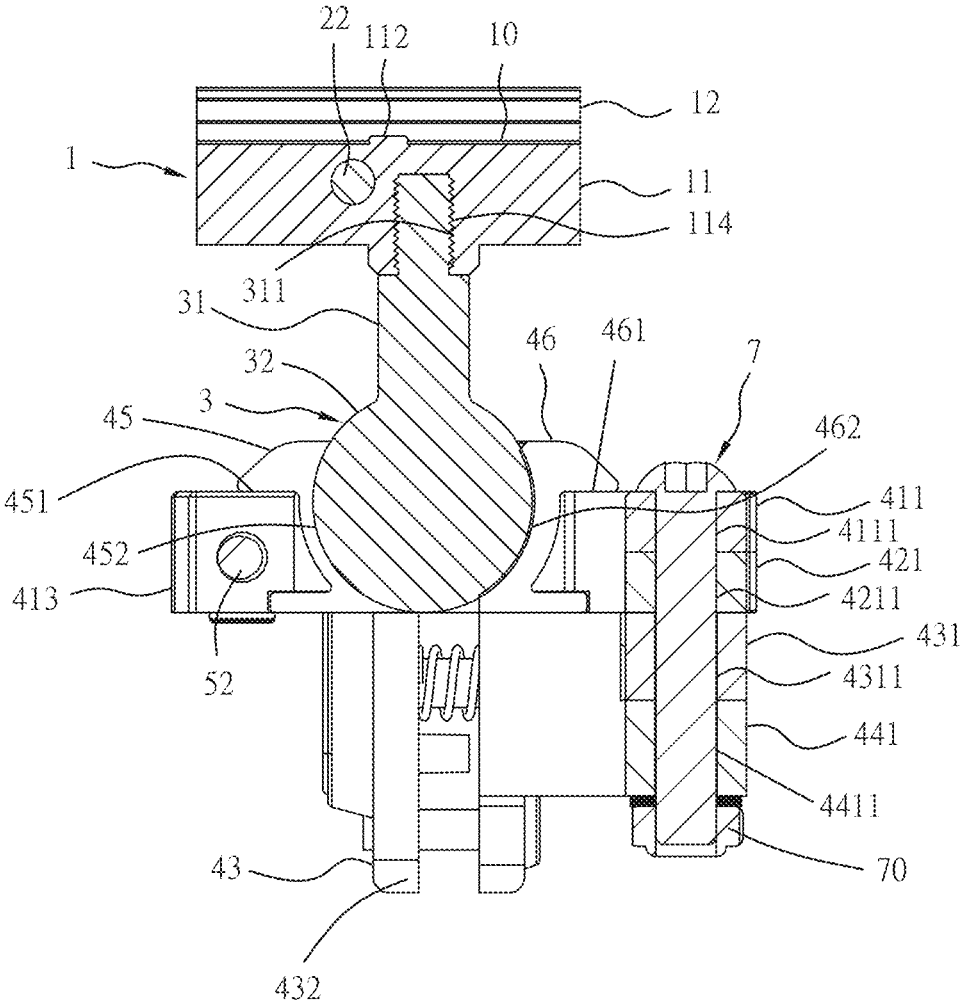
FIG. 8 is a sectional assembly view of the bipod base in accordance with the present invention.
Figure 9:
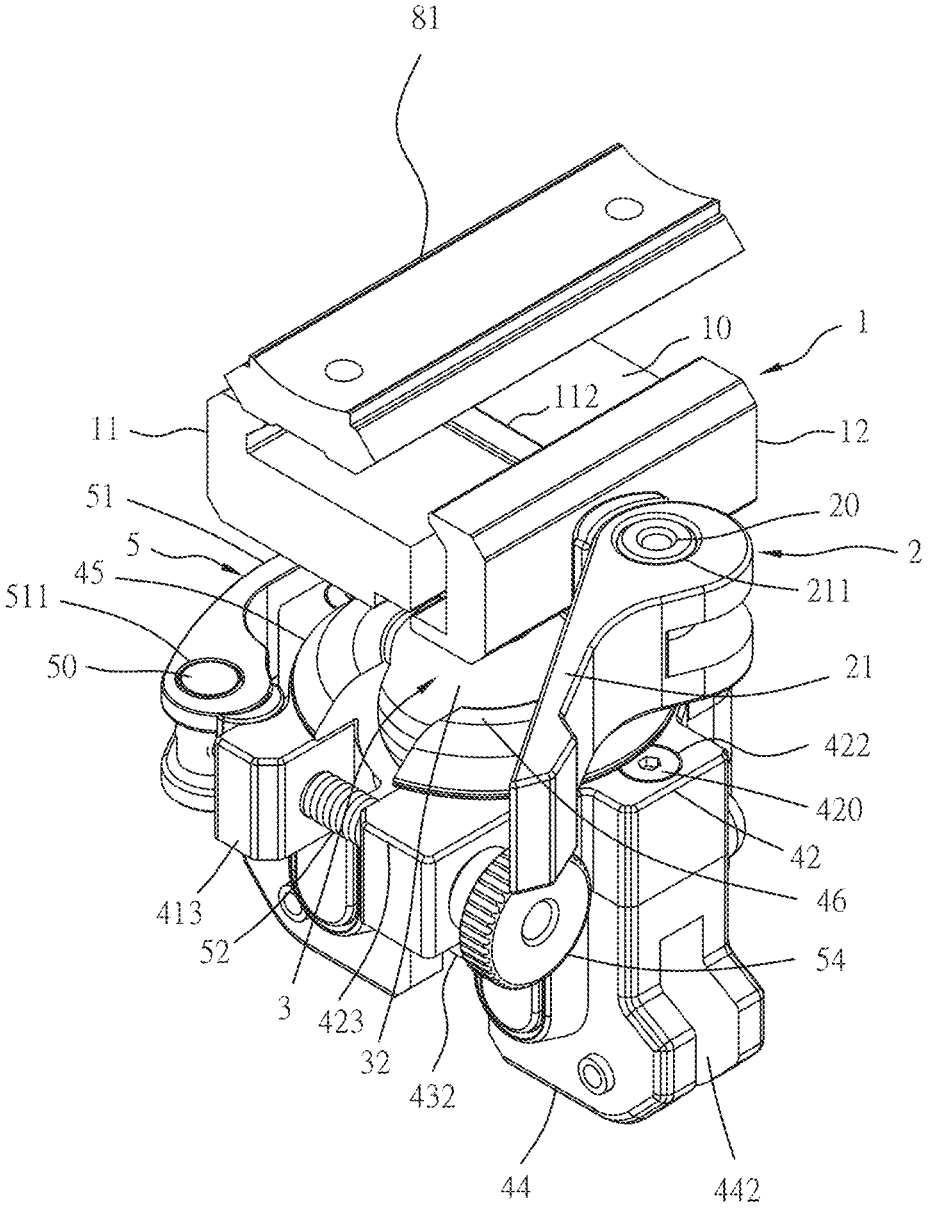
FIG. 9 illustrates the relationship between the rail clamp of the bipod base of the present invention and the rail of a gun before installation.
Figure 10:
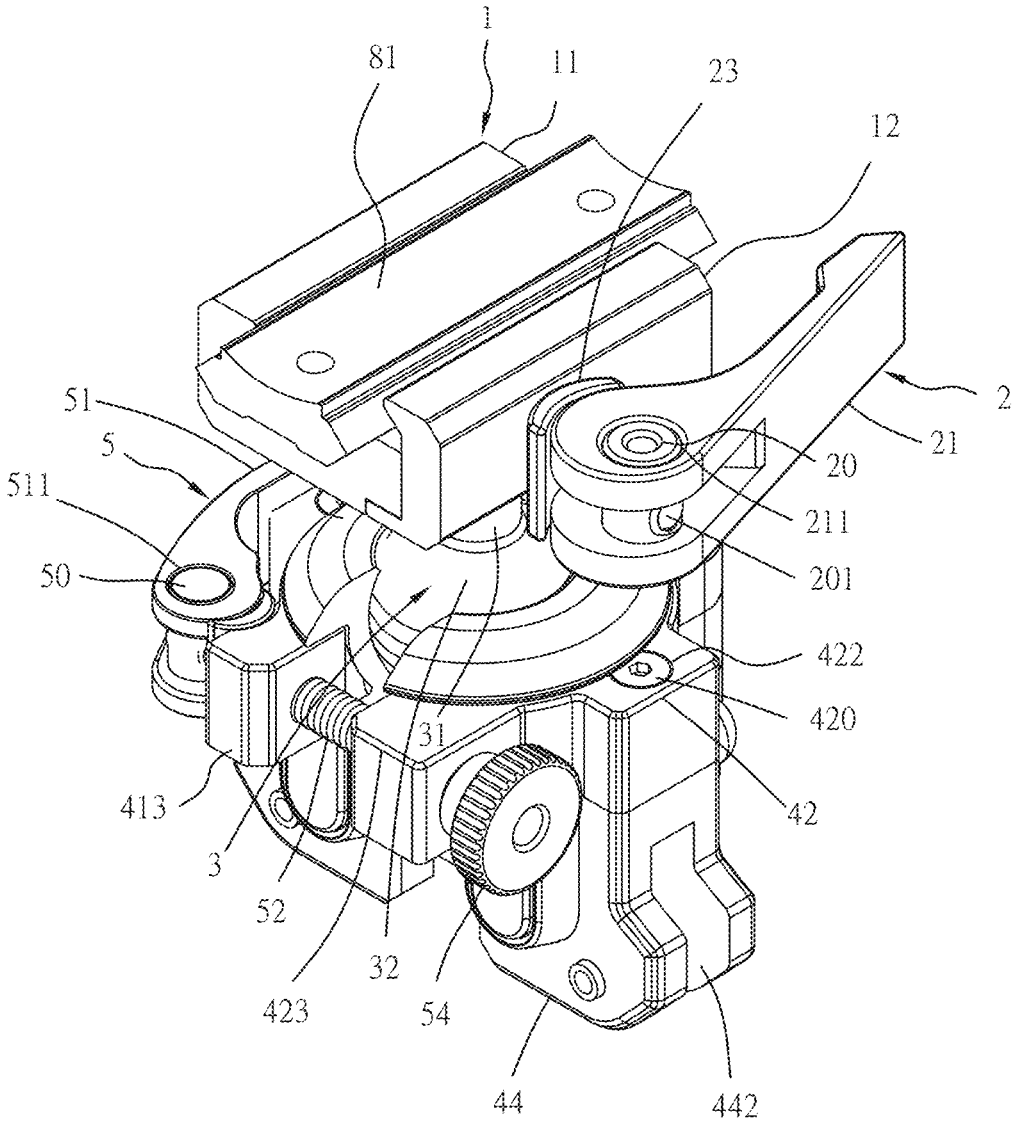
FIG. 10 corresponds to FIG. 9, illustrating the rail of the gun locked to the rail clamp of the bipod base of the present invention.
Figure 11:
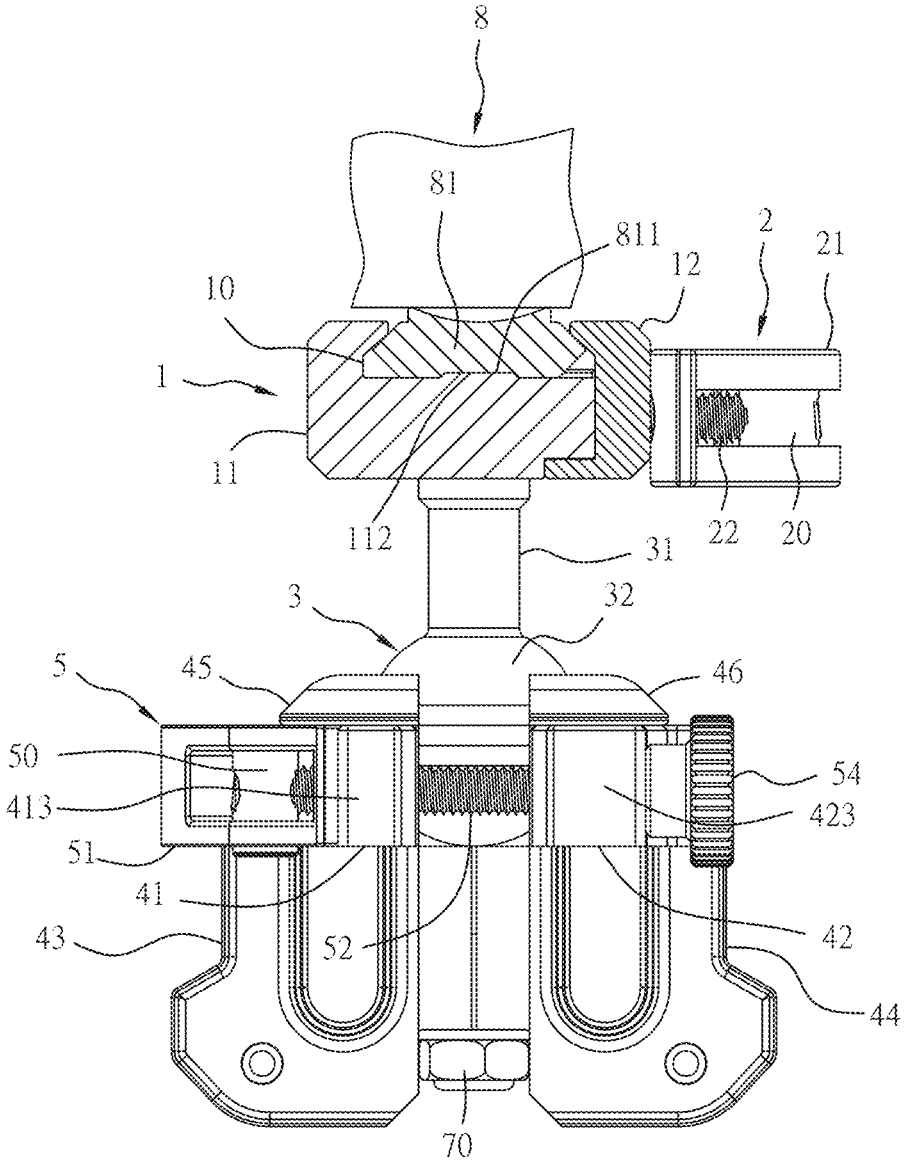
FIG. 11 is a schematic sectional view illustrating the rail of the gun locked to the rail clamp of the bipod base of the present invention.

A pivot bolt 7 (see FIGS. 4-8) is inserted through the first pivot hole 4111 of the first housing clamp 41, the second pivot hole 4211 of the second housing clamp 42, the third pivot hole 4311 of the first leg attachment 43 and the fourth pivot hole 4411 of the second leg attachment 44 and screwed up with a nut 70 to pivotally connect the first housing clamp 41, the second housing clamp 42, the first leg attachment 43 and the second leg attachment 44 together (see FIGS. 6 and 8).

The first spherical bushing 45 (see FIGS. 1, 4-6 and 8) comprises a first mounting groove 451 (see FIGS. 4 and 8) attached to a middle part of the first housing clamp 41 (see FIGS. 5 and 8), and a smoothly arched recess 452 defined in an inner side thereof (see FIGS. 5 and 8) for releasably clamping the ball 32 of the ball joint 3 (see FIG. 8).

The second spherical bushing 46 (see FIGS. 1, 4-6 and 8) comprises a 10 second mounting groove 461 (see FIGS. 4 and 8) attached to a middle part of the second housing clamp 42 (see FIGS. 5 and 8), and a smoothly arched recess 462 defined in an inner side thereof (see FIGS. 5 and 8) for releasably clamping the ball 32 of the ball joint 3 (see FIG. 8).

The second quick-release 5 (see FIGS. 1 and 4) comprises a second quick release handle 51, a second pivot axle 50, a second screw rod 52 (see FIGS. 1 and 4), a second gasket 53 and a second knob 54. The second quick release handle 51 comprises an eccentric shaft hole 511 (see FIGS. 1 and 4) located in one end thereof and pivotally coupled to the second pivot axle 50. The second pivot axle 50 comprises a second screw hole 501 fastened up with one end of the second screw rod 52. The other end 522 of the second screw rod 52 (see FIG. 4) is inserted through the second gasket 53, the first through hole 4131 of the first housing clamp 41, the second through hole 4231 of the second housing clamp 42 (see FIG. 4) and then threaded into an internally threaded hole 541 of the second knob 54.

Thus, biasing the second quick release handle 51 clockwise or counter-clockwise can fasten tight or loosen the first protruded wall 413 of the first housing clamp 41 and the second protruded wall 423 of the second housing clamp 42 to further fasten tight or loosen the first spherical bushing 45 and the second spherical housing 46.

Figure 12:
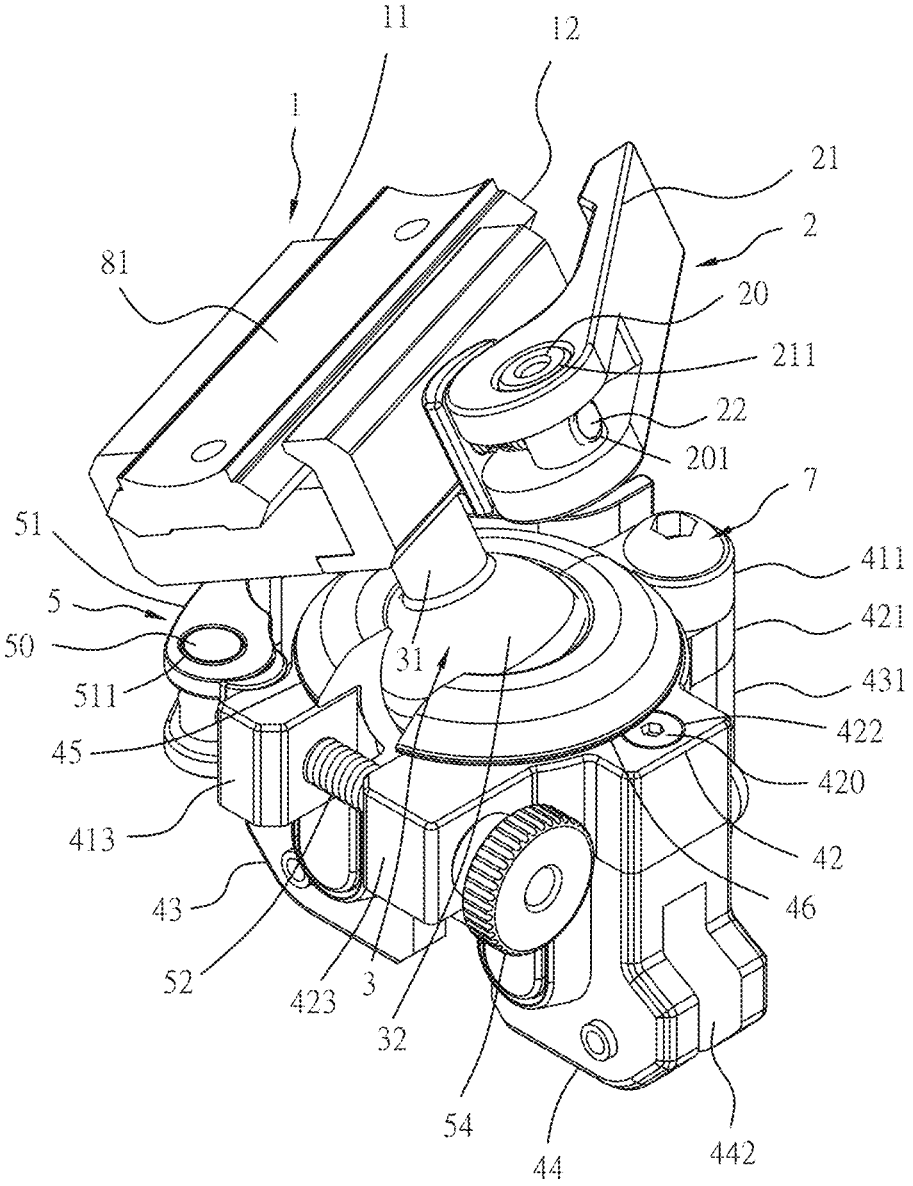
FIG. 12 is a schematic elevational view illustrating an example of the adjustment of the angular position of the rail clamp.
Figure 13:
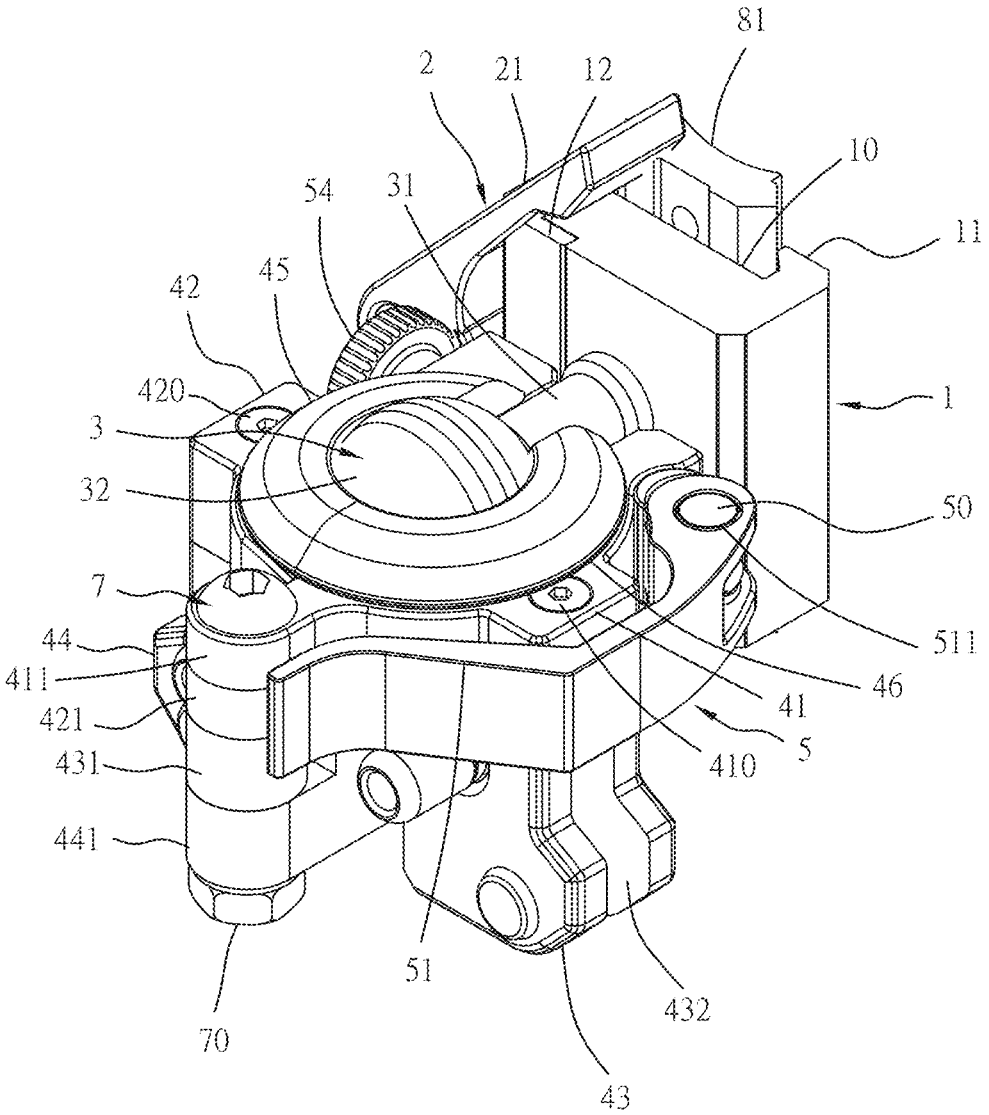
FIG. 13 is a schematic elevational view illustrating another example of the adjustment of the angular position of the rail clamp.

By the composition of the aforementioned component parts, when the first quick release handle 21 of the first quick-release 2 is biased counter-clockwise to loosen the movable rail 12 (see FIG. 9), the rail groove 10 of the rail clamp 1 is allowed for the mounting of the rail 81 of the gun 8. After insertion of the rail 81 of the gun 8 into the rail groove 10 of the rail clamp 1, one of the retaining grooves 811 in the bottom wall of the rail 81 is forced into engagement with the engagement block 112 of the fixed rail 11 of the rail clamp 1. Thereafter, bias the first quick release handle 21 clockwise to fasten up the movable rail 12, thereby locking the rail 81 of the gun 8 to the fixed rail 11 and movable rail 12 of the rail clamp 1 (see FIGS. 10 and 11). When the second quick release handle 51 of the second quick-release 5 is biased clockwise to loosen the first and second protruded walls 413,423 of the first and second housing clamps 41,42, the first and second spherical bushings 45,46 are released from the ball 32 of the ball joint 3, allowing 360-degree angular position adjustment of the rail clamp 1 with the ball 32 of the ball joint 3 relative to the first and second spherical bushings 45,46 and the first and second housing clamps 41,42. After adjusted to the designed angle, bias the second quick release handle 51 counter-clockwise to fasten tight the first and second protruded walls 413,423 of the first and second housing clamps 41,42, tightening up the first and second spherical bushings 45,46 in the smoothly arched recesses 452,462 to hold down the ball 32 of the ball joint 3 in a surface contact manner (see FIG. 11). FIGS. 12 and 13 illustrate different angular adjustment examples of the bipod base.

Further, the fixed rail 11 of the rail clamp 1 defines therein a first spring hole 113 (see FIG. 2); the movable rail 12 defines therein a second spring hole 123 that faces toward the first spring hole 113 (see FIG. 7); a spring 13 is mounted between the first mounting hole 113 and the second mounting hole 123 (see FIG. 2). When the first quick release handle 21 of the first quick-release 2 to loosen the first quick-release 2 (see FIG. 7), the elastic restoring energy of the spring 13 pushes the movable rail 12 and the fixed rail 11 away from each other for allowing insertion of the rail 81 of the gun 8 into the rail groove 10 (see FIG. 10).

In summary, the invention achieves the following effects:

1. When the second quick-release 5 is loosened, the first and second housing clamps 41,42 are allowed for 360-degree adjustment with the first and second spherical bushings 45,46 relative to the ball 32 of the ball joint 3. When the second quick-release 5 is fastened tight, the first and second housing clamps 41,42 are clamped on the ball joint 3 by means of a surface contact mode, achieving positive locking.

2. In installation, the first and second housing clamps 41,42, the first and second spherical bushings 45,46 and the first and second leg attachments 43,44 can be assembled together in advance (see FIGS. 2 and 3), the rail clamp 1 and the ball joint 3 can also be assembled together in advance (see FIGS. 4 and 5), thereafter, as illustrated in FIG. 6, bias open the first housing clamp 41 with its connected first leg attachment 43 relative to the second housing clamp 42 and its connected second leg attachment 44 for allowing attachment of the first and second spherical bushings 45,46 onto the ball joint 3, and then fasten tight the second quick-release 5 (see FIG. 6), achieving quick and accurate installation.

What is claimed is:

1. A bipod base, comprising: a rail clamp comprising a fixed rail and a movable rail, said fixed rail and said movable rail defining therebetween a rail groove for the mounting of a rail of a gun, said fixed rail comprising an internally threaded hole extended in a transverse direction, at least one engagement block located on a top side thereof and an internally threaded hole vertically located on an opposing bottom side thereof, said movable rail comprising a through hole aimed at the said transverse extending internally threaded hole of said fixed rail;

a first quick-release comprising a first quick release handle, a first pivot axle, a first screw rod and a first gasket, said first quick release handle comprising an eccentric shaft hole located in one end thereof and pivotally coupled to said first pivot axle, said first screw rod having one end thereof extending through said first gasket, said first pivot axle provided with a first screw hole and fastened up with said one end of said first screw rod, an opposite end of said screw rod engaging said transverse extending internally threaded hole of said fixed rail, the said through hole of said movable rail of said rail clamp and then threaded into the said transverse extending internally threaded hole of said fixed rail of said rail clamp;

a ball joint comprising a rod member and a ball located on a bottom end of said rod member, said rod member having an opposite top end terminating in an externally threaded end-piece that is fastened to the said internally threaded hole of said fixed rail of said rail clamp;

a first housing clamp comprising a protruded first pivot connection portion disposed at one side thereof, a first pivot hole defined in said first pivot connection portion, a first protruded wall disposed at an opposite side thereof, a first through hole transversely cut through said first protruded wall and a first mounting hole fastened to a first leg attachment with a first fastening member;

a second housing clamp comprising a protruded second pivot connection portion, a second pivot hole defined in said second pivot connection portion, a second protruded wall disposed at an opposite side thereof, a second through hole transversely cut through said second protruded wall and a second mounting hole fastened to a second leg attachment with a second fastening member;

the first leg attachment fastened to said first housing clamp, said first leg attachment comprising a third pivot connection portion disposed at one side thereof, a third pivot hole defined in said third pivot connection portion and a first leg hole for the connection of a first leg;

a second leg attachment fastened to said second housing clamp, said second leg attachment comprising a fourth pivot connection portion, a fourth pivot hole defined in said fourth pivot connection portion and a first second leg hole for the connection of a second leg;

a pivot bolt inserted through said first pivot hole of said first housing clamp, said second pivot hole of said second housing clamp, said third pivot hole of said first leg attachment and said fourth pivot hole of said second leg attachment and screwed up with a nut to pivotally connect said first housing clamp, said second housing clamp, said first leg attachment and said second leg attachment together;

a first spherical bushing comprising a first mounting groove attached to a middle part of said first housing clamp and a smoothly arched recess defined in an inner side thereof for releasably clamping said ball of said ball joint;

a second spherical bushing comprising a second mounting groove attached to a middle part of said second housing clamp and a smoothly arched recess defined in an inner side thereof for releasably clamping said ball of said ball joint; and a second quick-release comprising a second quick release handle, a second pivot axle, a second screw rod, a second gasket and a second knob, said second quick release handle comprising an eccentric shaft hole located in one end thereof and pivotally coupled to said second pivot axle, said second pivot axle comprising a second screw hole fastened up with one end of said second screw rod, said second screw rod having an opposite end thereof inserted through said second gasket, said first through hole of said first housing clamp and said second through hole of said second housing clamp and then threaded into an internally threaded hole of said second knob.

2. The bipod base as claimed in claim 1, further comprising a spring mounted between said fixed rail and said movable rail and adapted for pushing said fixed rail and said movable rail in direction away from each other, wherein said fixed rail defines therein a first spring hole that accommodates one end of said spring; said movable rail defines therein a second spring hole that accommodates an opposite end of said spring.

* * * * *